US008228276B2

(12) United States Patent
Lee et al.

(10) Patent No.: US 8,228,276 B2
(45) Date of Patent: Jul. 24, 2012

(54) DISPLAY DRIVER APPARATUS AND INVERSION DRIVING METHOD THEREOF

(75) Inventors: Hsueh-Yi Lee, Hsinchu (TW); Chih-Wei Tang, Penghu County (TW); Wing-Kai Tang, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 1708 days.

(21) Appl. No.: 11/533,374

(22) Filed: Sep. 20, 2006

(65) Prior Publication Data

US 2007/0296675 A1 Dec. 27, 2007

(30) Foreign Application Priority Data

Jun. 22, 2006 (TW) ..... 95122418 A

(51) Int. Cl.
*G09G 3/36* (2006.01)

(52) U.S. Cl. ..... 345/89; 345/90; 345/204

(58) Field of Classification Search ..... 345/89–90, 345/204, 55

See application file for complete search history.

(56) References Cited

U.S. PATENT DOCUMENTS

| | | | | |
|---|---|---|---|---|
| 7,033,058 | B2 * | 4/2006 | Liu | 362/559 |
| 7,859,504 | B2 * | 12/2010 | Furihata et al. | 345/98 |
| 2007/0046606 | A1 * | 3/2007 | Kim et al. | 345/90 |
| 2011/0074661 | A1 * | 3/2011 | Koyama | 345/80 |

* cited by examiner

*Primary Examiner* — Nitin Patel
*Assistant Examiner* — Leonid Shapiro
(74) *Attorney, Agent, or Firm* — Jianq Chyun IP Office

(57) ABSTRACT

A display driver apparatus and an inversion method thereof are provided. The display driver apparatus includes a gate drive unit, a source drive unit, a multiplexer unit and a common voltage generation unit. The gate drive unit is used to generate a gate signal for turning on/off sub-pixels. The source drive unit is used to generate a source signal required by the display panel. The multiplexer unit is used to regulate the sequence for the source signal to be delivered to the sub-pixels. The common voltage generation unit is used to generate a common voltage and switch the level of the common voltage during the enable period of the gate signal.

13 Claims, 9 Drawing Sheets

DISPLAY DRIVER APPARATUS AND INVERSION DRIVING METHOD THEREOF

CROSS-REFERENCE TO RELATED APPLICATION

This application claims the priority benefit of Taiwan application serial no. 95122418, filed Jun. 22, 2006. All disclosure of the Taiwan application is incorporated herein by reference.

BACKGROUND OF THE INVENTION

1. Field of the Invention

The present invention relates to a display driver apparatus, and more particularly, to a display driver apparatus suitable for driving a liquid crystal display panel and an inversion driving method thereof.

2. Description of Related Art

A thin-film transistor liquid crystal display (TFT LCD) panel employs liquid crystals as the material for controlling the displaying effect, thus, in order to avoid the phenomenon of residual image caused by the liquid crystal polarization, the voltage polarity of a source signal must be periodically converted. The inversion driving method for the liquid crystal display panel comprises, for example, line inversion, column inversion, dot inversion, and the like. The ability for restraining flicker phenomenon is different for each inversion driving method. For example, the dot inversion uses the dot as a unit to perform the inversion driving, so it has better restraining effect to the flicker phenomenon.

Considering the cost, the conventional medium/small-sized TFT LCD generally employs the line inversion driving method. Take the conventional TFT LCD in FIG. 1 as an example, Rn, Gn, Bn in the liquid crystal display panel 101 represent three sub-pixels (or "dot") for forming the $n^{th}$ pixel, corresponding to three primary colors red, green and blue respectively, wherein + represents positive polarity and − represents negative polarity. As shown in FIG. 1, the so-called line inversion means that, in the same frame, two adjacent gate lines (e.g., GL1 and GL2) employ opposite voltage polarities, and the polarity of the same gate line is also inverted between two successive frames.

Continue referring to FIGS. 1 and 2, a gate driver 102 is used to generate gate signals G1-G3, a source driver 106 is used to generate source signals S1-S3, and a common voltage generation unit 110 is used to generate a common voltage VCOM1. During an enable period T1 of the gate signal G1, each of the multiplexer units 103-105 respectively turns on the switches in the multiplexer units 103-105 in sequence according to switch signals SW1-SW6, and thereby, the source signal S1 is delivered to sub-pixels R0, G0, B0, R1, G1, B1 through the gate line GL1 in sequence, and the circumstance of the source signals S2 and S3 goes the same. As the common voltage at this time is a first voltage level V11, the voltage polarities of source signals S1-S3 delivered to the sub-pixels at this time are positive. After that, during the enable period T2 of a gate signal G2, the voltage polarities of source signals S1-S3 delivered by each multiplexer unit 103-105 are all negative. Thus, the conventional TFT LCD achieves displaying each frame by way of the line inversion driving.

However, the line inversion driving method of the conventional TFT LCD easily causes crosstalk and flicker phenomena in terms of the image quality. The flicker phenomenon caused by the line inversion is especially severe since the flicker phenomenon is generated with the line as a unit and is easy to be sensed by the user (which is even more severe in frame inversion display method). In other words, as the era of the high-pixel is coming, the image quality of the conventional TFT LCD is limited by the line inversion driving method, and also in frame inversion method, and cannot be further improved.

SUMMARY OF THE INVENTION

An objective of the present invention is to provide a display driver apparatus, which is used to achieve a plurality of inversion driving methods by switching a common voltage level of a liquid crystal display panel and regulating the sequence for delivering a source signal to sub-pixels during an enable period of a gate signal, so as to improve the image quality of the display.

Another objective of the present invention is to provide an inversion driving method, which is used to achieve a plurality of inversion driving methods, so as to effectively improve the image quality of a display.

In order to achieve the above-mentioned or other objectives, the present invention provides a display driver apparatus, suitable for driving the liquid crystal display panel. The liquid crystal display panel comprises a plurality of source lines and a plurality of sub-pixels. The display driver apparatus comprises a gate drive unit, a source drive unit, a multiplexer unit and a common voltage generation unit.

The gate drive unit is used to generate a gate signal for turning on/off the sub-pixels. The source drive unit is used to generate a source signal required by the display panel, together with the above-mentioned gate signal. The multiplexer unit is used to couple the input terminal of the multiplexer unit to one of the source lines in turn during the enable period of the gate signal. The common voltage generation unit is used to generate a common voltage to the liquid crystal display panel and switches the level of the common voltage during the enable period of the gate signal.

In an embodiment of the present invention, the level of the common voltage comprises a first voltage level and a second voltage level. When the level of the common voltage is the first voltage level, the corresponding source signal is the first drive polarity. When the level of the common voltage is the second voltage level, the corresponding source signal is the second drive polarity.

From another aspect, the present invention further provides an inversion driving method, suitable for driving a liquid crystal display panel, wherein the liquid crystal display panel comprises a plurality of source line groups. The inversion driving method comprises: providing a gate signal to the liquid crystal display panel; then, providing a common voltage to the liquid crystal display panel, and switching the level of the common voltage during the enable period of the gate signal; then, during the enable period of the gate signal, further delivering a source signal to each source line group respectively, wherein a plurality of source lines in each source line group is used to deliver the source signal in turn according to a preset sequence.

In an embodiment of the present invention, the above-mentioned preset sequence according to which the source lines are operated comprises: during the first half of the enable period of the gate signal, the first group delivers the source signal in turn; and during the latter half of the enable period of the gate signal, the second group delivers the source signal in turn. The enable period of the gate signal is divided into the first half of the enable period and the latter half of the enable period according to the time point for switching the level of the common voltage.

The present invention achieves a plurality of inversion driving methods by switching the level of the common voltage during the enable period of the gate signal, and thereby effectively enhancing the image quality of the display.

In order to make the aforementioned and other objectives, features and advantages of the present invention comprehensible, preferred embodiments accompanied with figures are described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

The characteristic of the display driver apparatus provided in the present invention lies in that, the driver apparatus switches the level of the common voltage during the enable period of the gate signal. Thereby, source signals with different voltage polarities are loaded into sub-pixels on the same gate line, so as to achieve a plurality of inversion driving methods.

Figure 1:
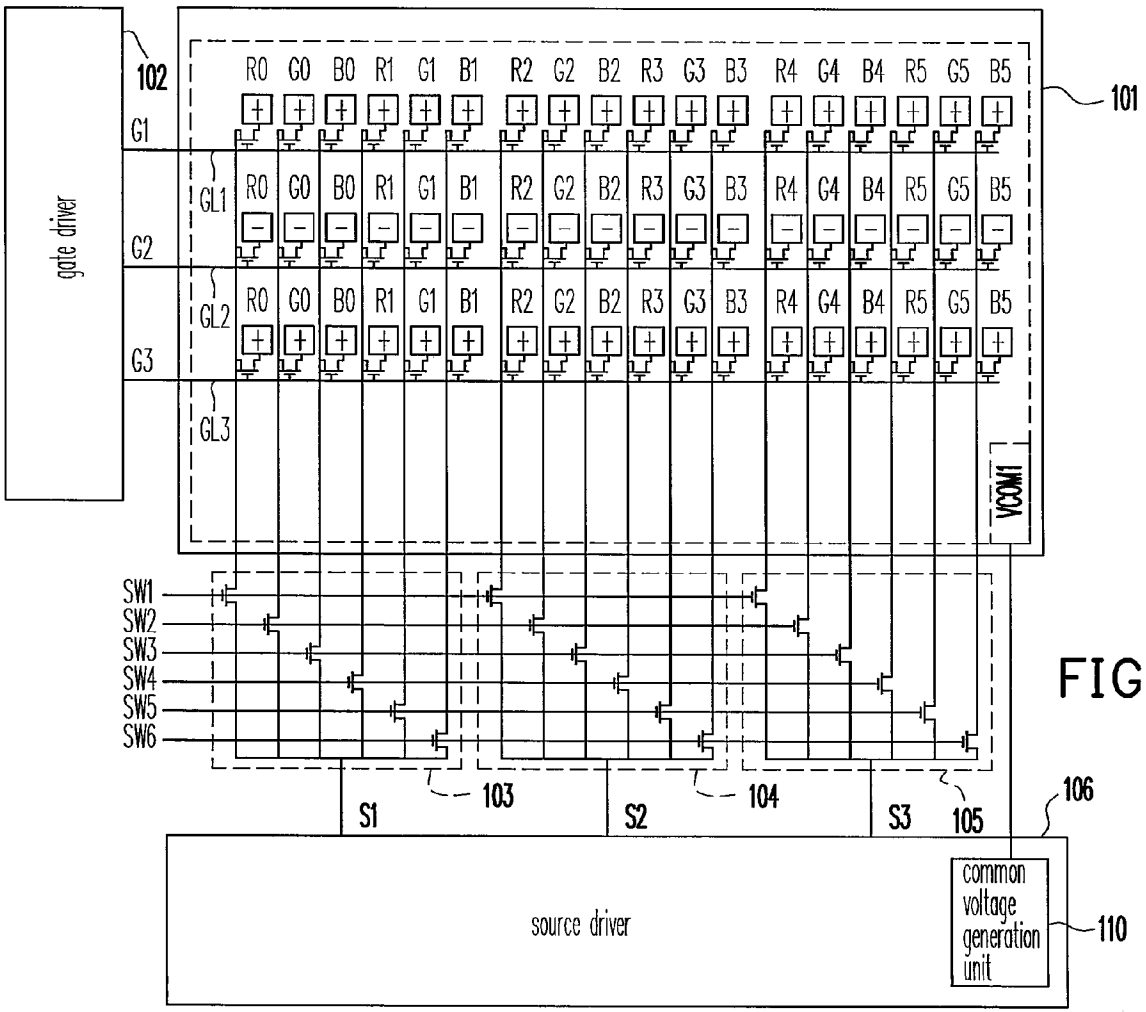
FIG. 1 (PRIOR ART)
FIG. 1 is an architecture diagram of a conventional thin-film transistor liquid crystal display.
Figure 2:
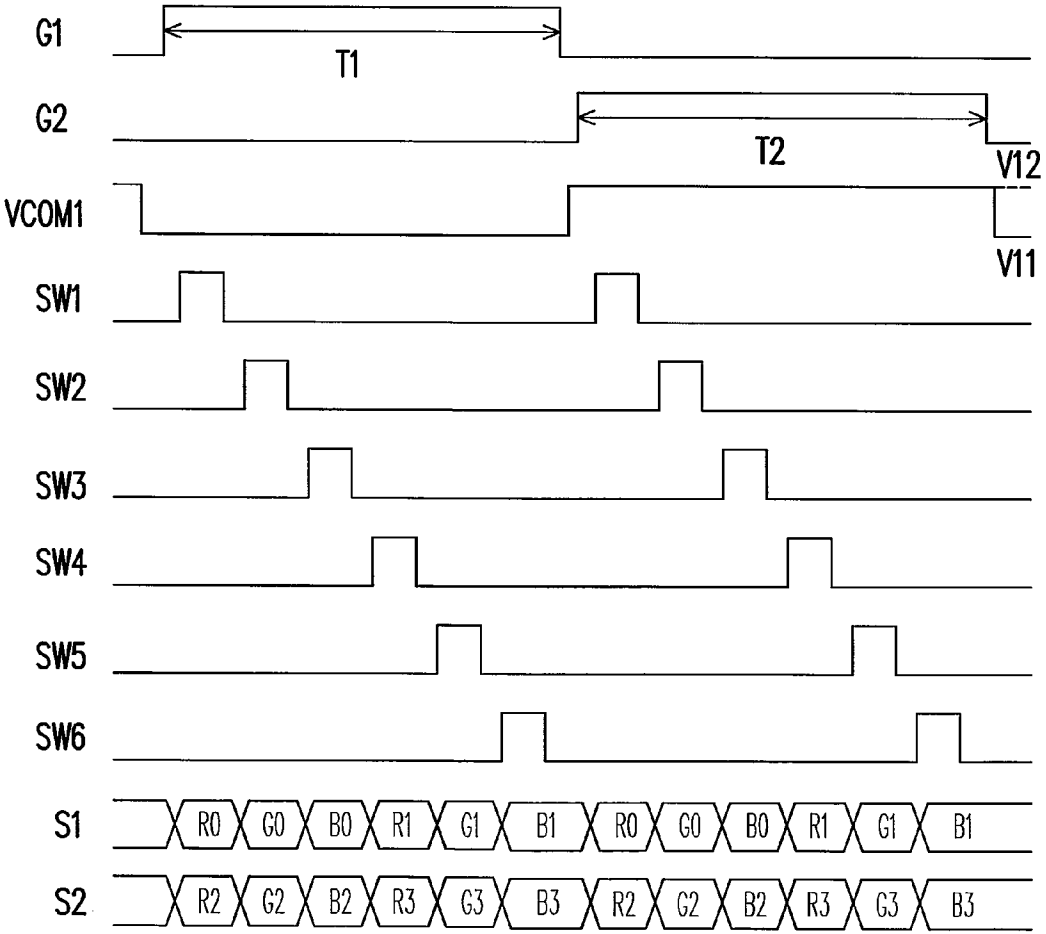
FIG. 2 (PRIOR ART)
FIG. 2 is a timing diagram for illustrating the driving method shown in FIG. 1.
Figure 3:
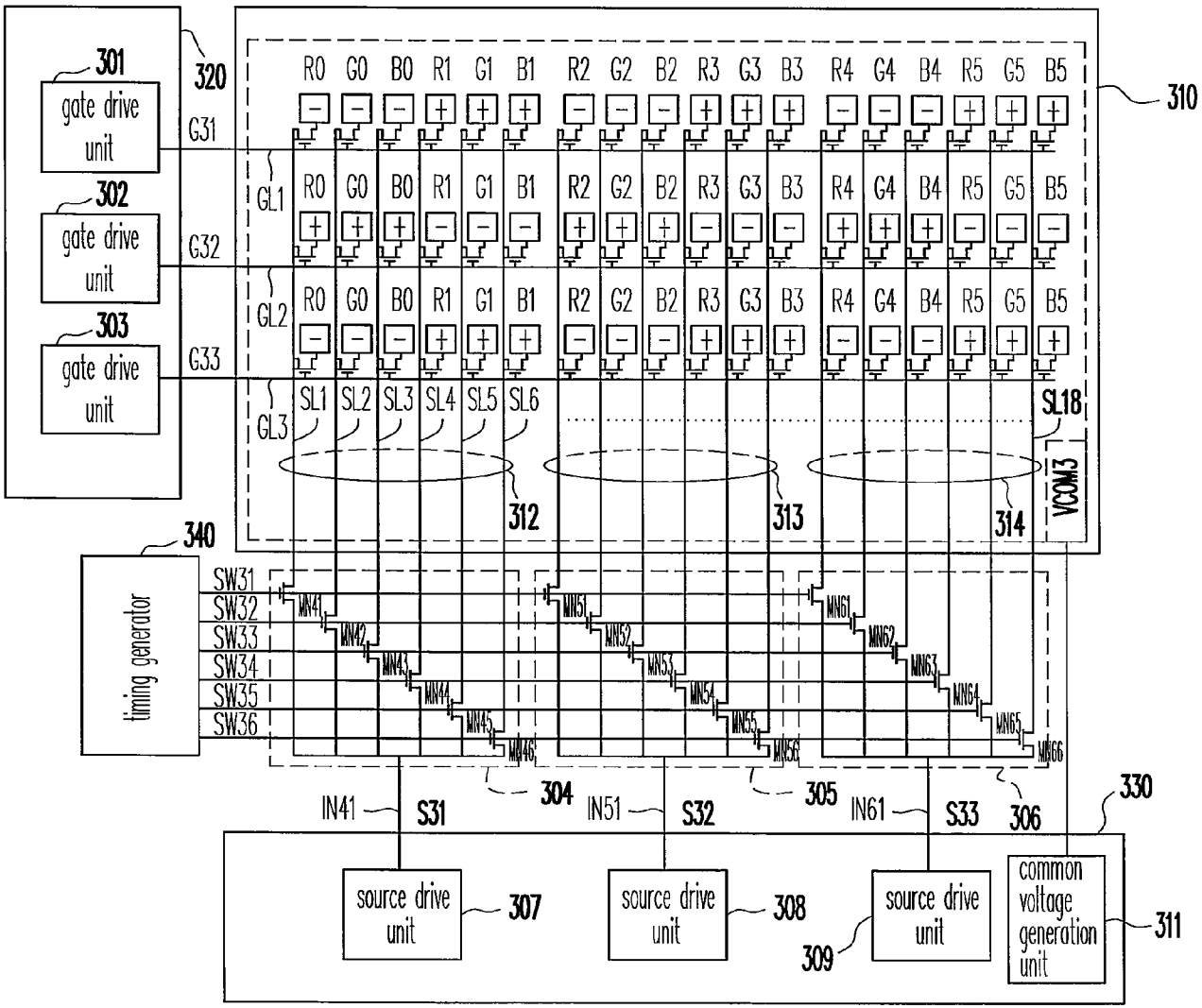
FIG. 3 is an architecture diagram of a display driver apparatus according to an embodiment of the present invention.

FIG. 3 is an architecture diagram of a display driver apparatus according to an embodiment the present invention, which is suitable for driving a liquid crystal display panel 310. As shown in FIG. 3, the display driver apparatus of this embodiment comprises: gate drive units 301-303, multiplexer units 304-306, source drive units 307-309, a common voltage generation unit 311 and a timing generator 340. The gate drive units 301-303 are contained in the gate driver 320. The source drive units 307-309 and the common voltage generation unit 311 are contained in the source driver 330. In addition, the liquid crystal display panel 310 comprises a plurality of source line groups 312-314 and a plurality of sub-pixels R0-R5, G0-G5 and B0-B5, wherein each of the source line groups 312-314 comprises a plurality of source lines, for example, the source line group 312 comprises source lines SL1-SL6.

The gate drive units 301-303 are coupled to the liquid crystal display panel 310. The input terminals of the multiplexer units 304-306 are respectively coupled to the source drive units 307-309. A plurality of output terminals of the multiplexer unit 304 are respectively coupled to the source lines SL1-SL6 one by one. Similarly, the coupling relationship for the output terminals of the multiplexer units 305 and 306 is the same. Further, the common voltage generation unit 311 is coupled to the liquid crystal display panel 310. The timing generator 340 is coupled to the multiplexer units 304-306.

The multiplexer unit 304 comprises switches MN41-MN46. The first ends of the switches MN41-MN46 are all coupled to the output terminal of the source drive unit 307. The second ends of the switches MN41-MN46 are respectively coupled to the source lines SL1-SL6 one by one. Furthermore, the coupling relationship of the switches MN51-MN56 and MN61-MN66 respectively contained in the multiplexer units 305 and 306 can be obtained similarly with reference to FIG. 3.

In the embodiment of FIG. 3, during the process of driving the liquid crystal display panel 310, the gate drive units 301-303 are respectively used to generate gate signals G31-G33 for turning on/off the sub-pixels. The source drive units 307-309 are used, together with the gate signals G31-G33, to generate source signals S31-S33 required by the display panel. The multiplexer unit 304 is used to couple the input terminal IN41 of the multiplexer unit 304 to one of the source lines SL1-SL6 in turn during the enable period of the gate signal. The multiplexer unit 305 is used to couple the input terminal IN51 of the multiplexer unit 305 to one of the source lines SL7-SL12 in turn during the enable period of the gate signal, and the multiplexer unit 306 goes the same way. The common voltage generation unit 311 is used to generate a common voltage VCOM3 to the liquid crystal display panel 310, and the level of the common voltage is respectively switched during the enable periods of the gate signals G31-G33. The timing generator 340 is used to output the switch signals SW31-SW36 according to a preset sequence.

Figure 4:
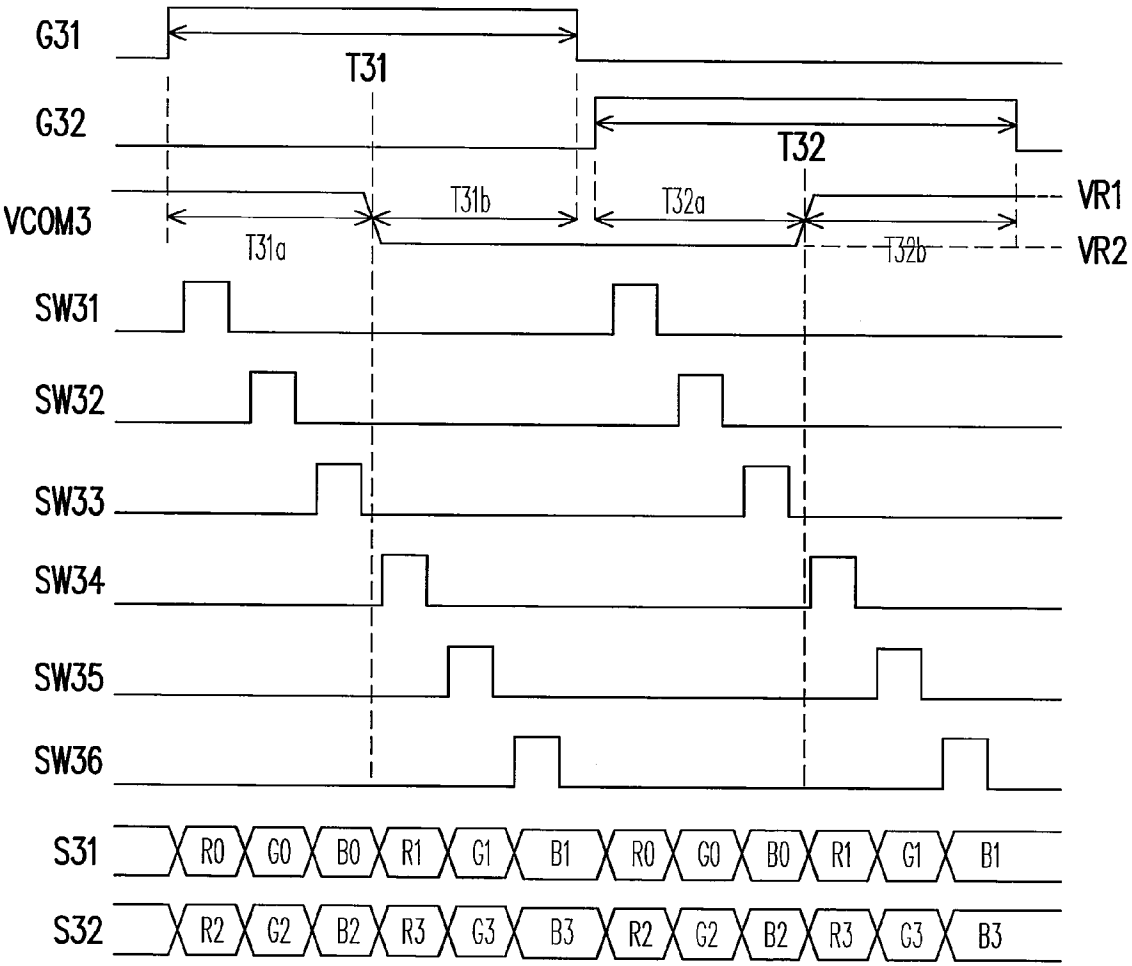
FIG. 4 is a timing diagram for illustrating the driving method shown in FIG. 3.

Next, referring to FIGS. 3 and 4, first, during the enable period T31 of the gate signal G31, the common voltage generation unit 311 switches the level of the common voltage VCOM3. The enable period T31 of the gate signal G31 is divided into a first half of the enable period T31*a* and a latter half of the enable period T31*b* according to the time point for switching the level of the common voltage VCOM3. Then, according to the preset sequence, the timing generator 340 outputs switch signals SW31, SW32, . . . , SW3(M/2) respectively in the first half of the enable period T31*a* of the gate signal G31, and outputs the switch signals SW3(M/2+1), SW3(M/2+2), . . . , SW3M respectively in the latter half of the enable period T31*b* of the gate signal G31, wherein M=6.

Therefore, the source signal S31 is delivered to the sub-pixels R0, G0, B0 on the gate line GL1 respectively during the first half of the enable period T31*a* of the gate signal G31. Since the common voltage VCOM3 at this time is a first voltage level VR1, the source signal S31 delivered to the sub-pixels R0, G0, B0 is of a first drive polarity (e.g., negative polarity). Correspondingly, the source signal S31 is delivered to the sub-pixels R1, G1, B1 on the gate line GL1 respectively in the latter half of the enable period T31*b* of the gate signal G31. Since the common voltage VCOM3 at this time is a second voltage level VR2, the source signal S31 delivered to the sub-pixels R1, G1, B1 is of a second drive polarity (e.g., positive polarity). The circumstance of the source signals S32 and S33 delivered during the enable period T31 can be obtained in a way similar to that described above.

Next, during the enable period T32 of the gate signal G32, the common voltage generation unit 311 also switches the level of the common voltage VCOM3. The enable period T32 is also divided into the first half of the enable period T32*a* and the latter half of the enable period T32*b* according to the time point for switching the level of the common voltage VCOM3. The source signals S31-S33 are also delivered to the source lines SL1-SL18 in the same sequence as that described above. The largest difference lies in that, the sequence for the source signals S31-S33 to be corresponding to the first level VR1 and the second level VR2 during the enable periods T31 and T32 are opposite to that described above, for example, the source signals S31-S33 correspond to the first level VR1 in the first half of the enable period T31*a* of the gate signal G31, and correspond to the second level VR2 in the first half of the enable period T32*a* of the gate signal G32. Therefore, the voltage polarities of two adjacent sub-pixels on the same source line are opposite, and the liquid crystal display panel 310 is driven by way of the dot inversion driving method.

From another aspect, the preset sequence for the source lines SL1-SL6 in the source line group 312 to deliver the source signal S31 may also be expressed as that, in the first half of the enable period T31*a* of the gate signal G31, the first group (the first half of source lines SL1-SL3) is used to deliver the source signal S31 in turn, and in the latter half of the enable period T31*b* of the gate signal G31, the second group (the latter half of the source lines SL4-SL6) is used to deliver the source signal S31 in turn.

It should be mentioned that, although a possible configuration of the internal circuits of the multiplexer units 304-306 has been described in the embodiment of FIG. 3, those skilled in the art should appreciate that the design of the multiplexer unit can comprise various configurations; therefore, the application of the present invention should not be limited to this possible configuration. In other words, as long as the multiplexer unit has an input terminal and a plurality of output terminals, and the connection state between the input terminal and the plurality of output terminals is determined by a plurality of switch signals, it falls within the spirit of the present invention.

Figure 5:
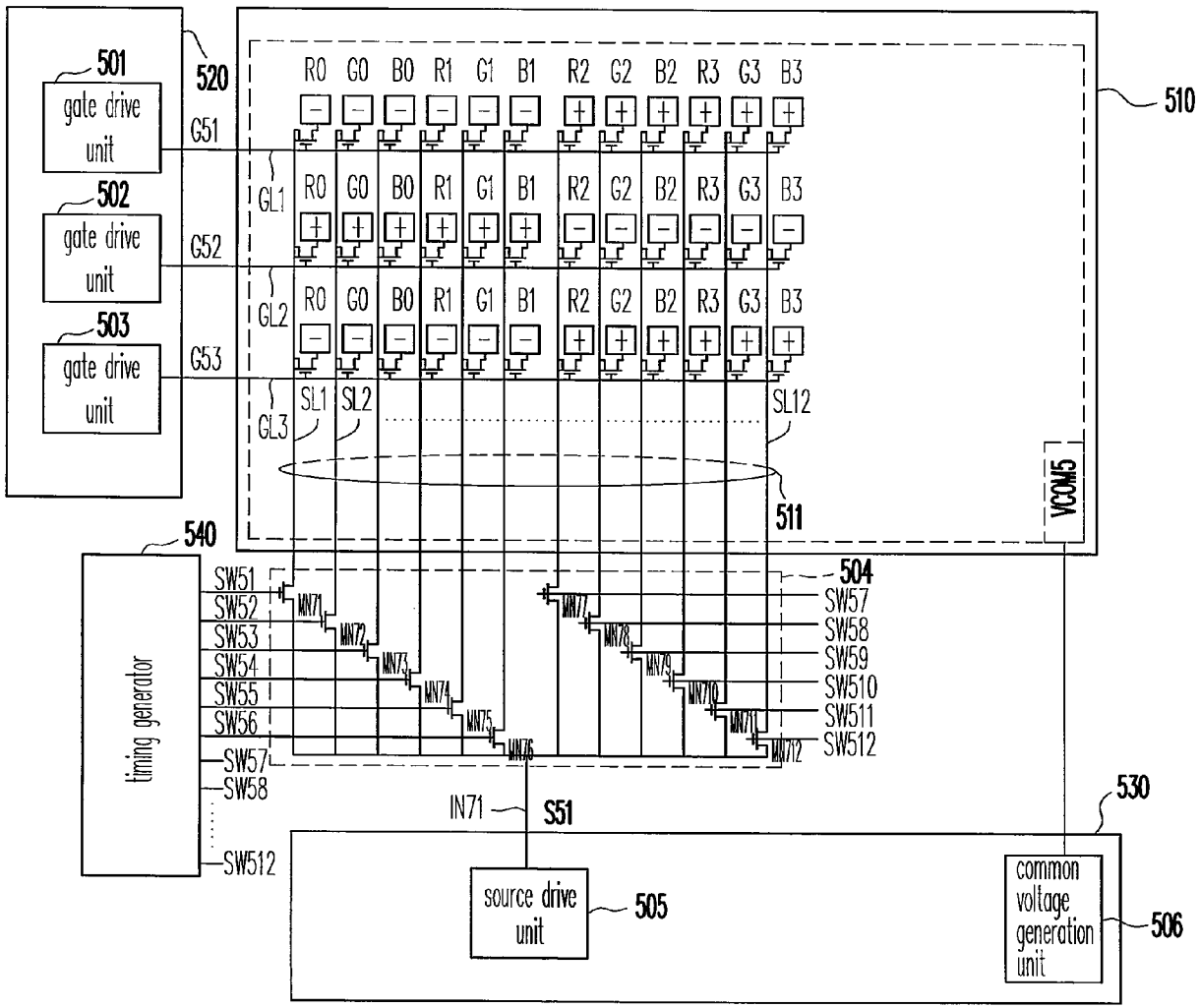
FIG. 5 is an architecture diagram of a display driver apparatus according to another embodiment of the present invention.

According to the spirit of the embodiment of FIG. 3, a 2-Dot inversion driving method may also be derived. As shown in FIG. 5, the display driver apparatus of this embodiment is used to drive a liquid crystal display panel 510, which comprises gate drive units 501-503, a multiplexer unit 504, a source drive unit 505, a common voltage generation unit 506 and a timing generator 540. The gate drive units 501-503 are contained in the gate driver 520. The source drive unit 505 and the common voltage generation unit 506 are contained in the source driver 530. Furthermore, the liquid crystal display panel 510 comprises a source line group 511 and a plurality of sub-pixels R0-R3, G0-G3, and B0-B3, wherein the source line group 511 comprises source lines SL1-SL12.

The multiplexer unit 504 comprises switches MN71-MN712. The first ends of the switches MN71-MN712 are all coupled to the output terminal of the source drive unit 505. The second ends of the switches MN71-MN712 are respectively coupled to the source lines SL1-SL12 one by one.

The gate drive units 501-503 are respectively used to generate gate signals G51-G53 for turning on/off the sub-pixels. The source drive unit 505 is used, together with the gate signals G51-G53, to generate the source signal S51 required by the display panel. The multiplexer unit 504 is used to couple the input terminal IN71 of the multiplexer unit 504 to one of the source lines SL1-SL12 in turn during the enable period of the gate signal. The common voltage generation unit 506 is used to generate a common voltage VCOM5 to the liquid crystal display panel 510, and switch the level of the common voltage respectively during the enable period of the gate signal. The timing generator 540 is used to output the switch signals SW51-SW512 according to a preset sequence.

The difference between the embodiment of FIG. 5 and the embodiment of FIG. 3 is that, the source drive unit 505 is used to drive 12 source lines, and the source drive unit 304 is used to drive 6 source lines. Therefore, the architecture of the internal circuit of the multiplexer unit 504 is different from that of the multiplexer unit 304. Comparatively, the number of switch signals generated by the timing generator 540 is determined depending upon the number of output terminals of the multiplexer unit 504.

Figure 6:
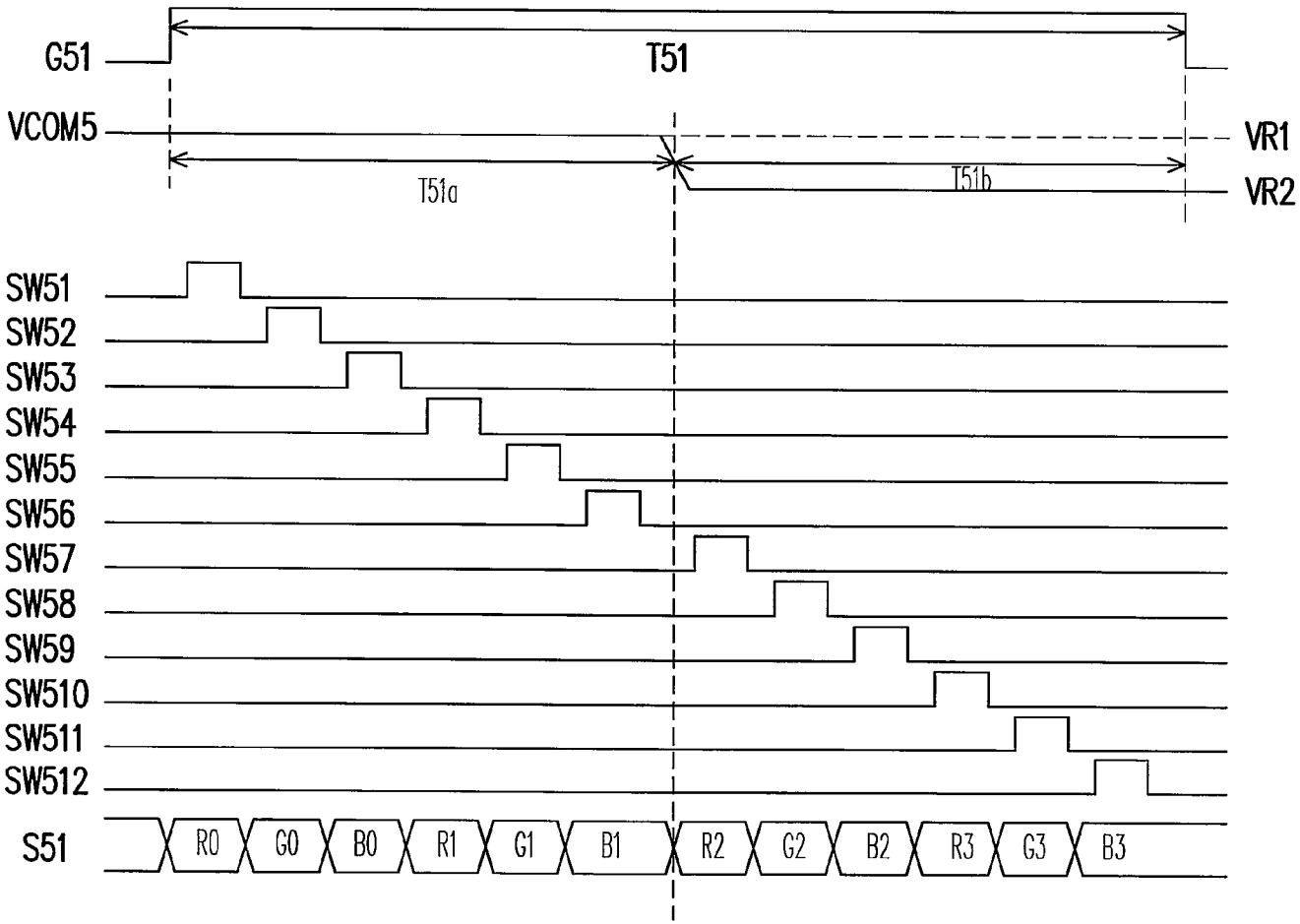
FIG. 6 is a timing diagram for illustrating the driving method shown in FIG. 5.

However, the preset sequence according to which the timing generator 540 is operated is similar to the concept of the embodiment of FIG. 3. Referring to FIGS. 5 and 6, the timing generator 540 outputs the switch signals SW51, SW52, . . . , SW5(N/2) respectively in the first half of the enable period T51*a* of the gate signal G51, and outputs the switch signals SW5(N/2+1), SW5(N/2+2), . . . , SW5N respectively in the latter half of the enable period T51*b* of the gate signal G51, wherein N=12. Thus, the source signal S51 delivered to the sub-pixels R0, G0, B0, R1, G1, B1 by the multiplexer unit 504 is of a first drive polarity (e.g., negative polarity). The source signal S51 delivered to the sub-pixels R2, G2, B2, R3, G3, B3 is of a second drive polarity (e.g., positive polarity). Thus, the liquid crystal display panel 510 in the embodiment of FIG. 5 is driven by the 2-Dot inversion driving method.

In addition, the preset sequence for the source lines SL1-SL12 to deliver the source signal S51 is that, in the first half of the enable period T51*a* of the gate signal G51, the first group (the first half of the source lines SL1-SL6) is used to deliver the source signal S51 in turn, and in the latter half of the enable period T51*b* of the gate signal G51, the second group (the latter half of the source lines SL7-SL12) is used to deliver the source signal S51 in turn.

Figure 7:
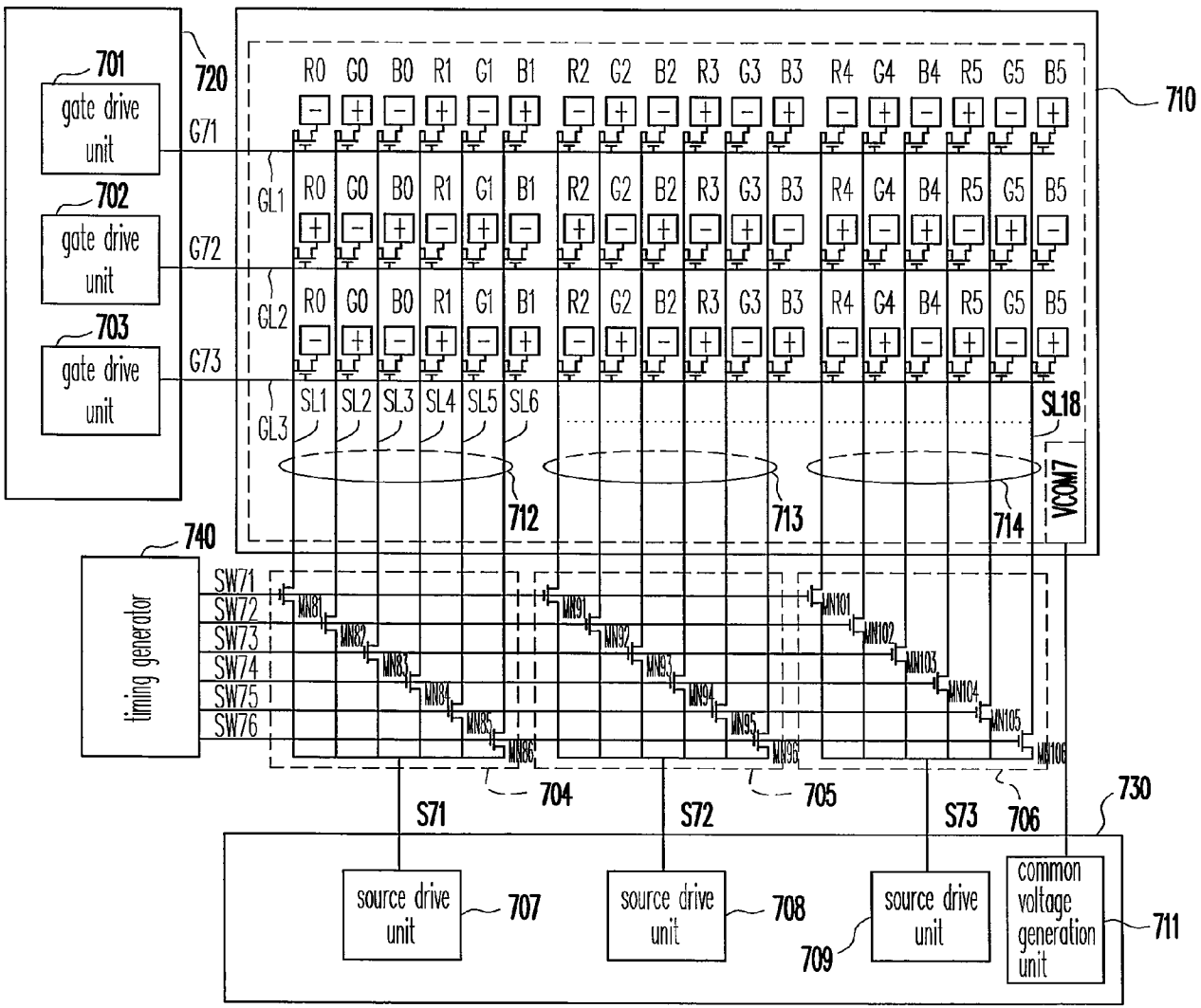
FIG. 7 is an architecture diagram of a display driver apparatus according to another embodiment of the present invention.

FIG. 7 is a display driver apparatus according to another embodiment of the present invention, which is suitable for driving a liquid crystal display panel 710. As shown in FIG. 7, the display driver apparatus of this embodiment comprises: gate drive units 701-703, multiplexer units 704-706, source drive units 707-709, a common voltage generation unit 711 and a timing generator 740. The gate drive units 701-703 are contained in the gate driver 720. The source drive units 707-709 and the common voltage generation unit 711 are contained in the source driver 730. Furthermore, the liquid crystal display panel 710 comprises a plurality of source line groups 712-714 and a plurality of sub-pixels R0-R5, G0-G5, and B0-B5, wherein each of the source line groups 712-714 comprises a plurality of source lines. Each of the multiplexer units 704-706 comprises switches MN81-MN86, MN91-MN96 and MN101-MN106.

Figure 8:
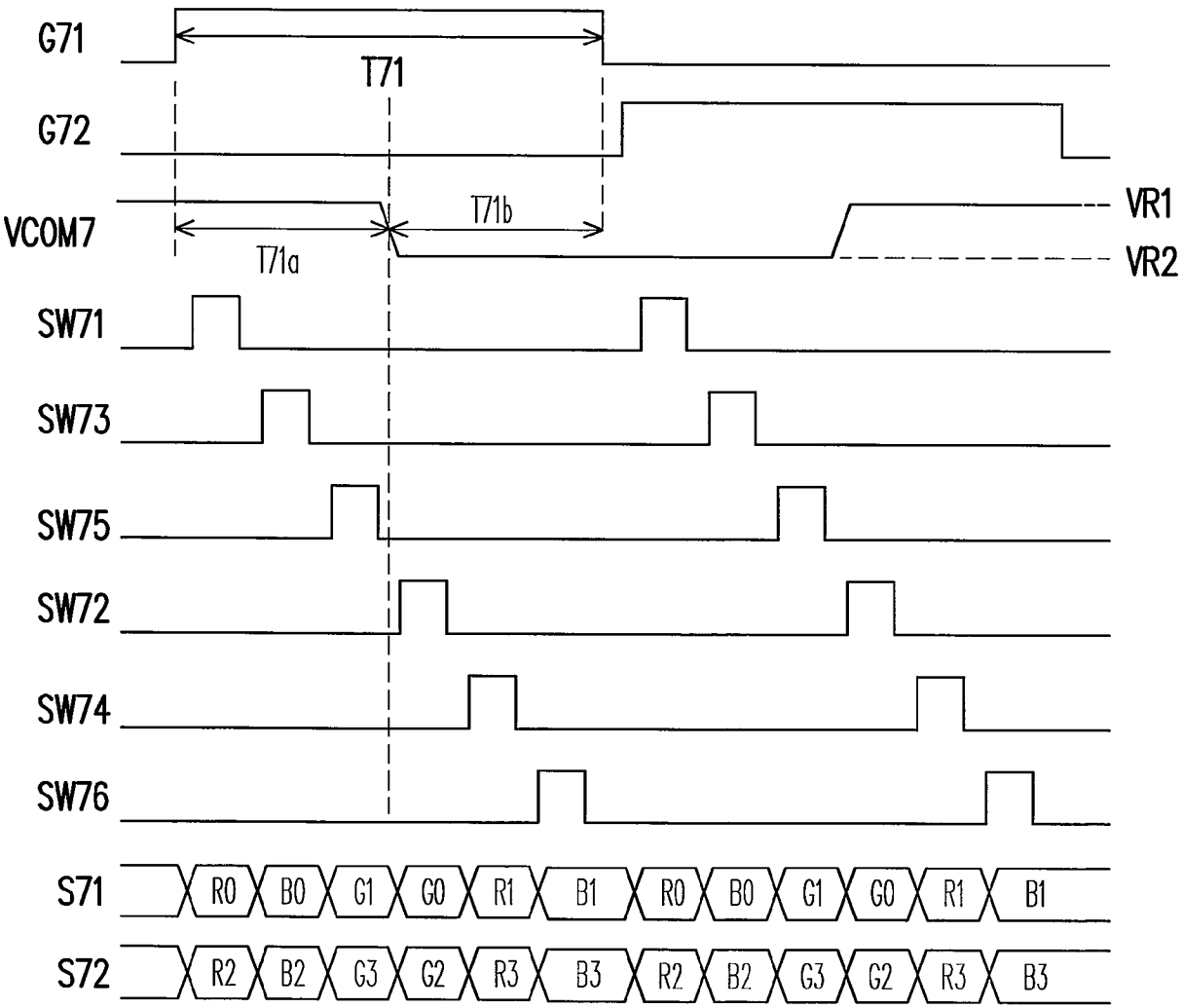
FIG. 8 is a timing diagram for illustrating the driving method shown in FIG. 7.

The operation principles and the coupling relationships for the embodiment of FIG. 7 and the embodiment of FIG. 3 are almost the same. The difference lies in that, the preset sequence according to which the timing generator 740 is operated is different from the preset sequence according to which the timing generator 340 is operated. Referring to FIGS. 7 and 8, the timing generator 740 outputs the switch signals SW71, SW73, . . . , SW7(I−1) respectively in the first half of the enable period T71*a* of the gate signal G71, and outputs the switch signals SW72, SW74, . . . , SW7I respectively in the latter half of the enable period T71*b* of the gate signal G71, wherein I=6. Thus, the source signal S71 delivered to the sub-pixels R0, B0, G1 by the multiplexer unit 704 is of a first drive polarity (e.g., negative polarity). The source signal S71 delivered to the sub-pixels G0, R1, B1 is of a second drive polarity (e.g., positive polarity).

Then, during the enable periods of the gate signals G72 and G73, the multiplexer unit 704 switches the source signal S71 through the same way. Thus, the liquid crystal display panel 710 is driven by the sub-pixel inversion driving method.

If the process for driving the liquid crystal display panel 710 in the embodiment of FIG. 7 is seen from the aspect of source line groups 712-714, the preset sequence for the source lines SL1-SL6 in the source line group 712 to deliver the source signal S71 may also be expressed as that, in the first half of the enable period T71*a* of the gate signal G71, the first group (odd-numbered source lines SL1, SL3, SL5) is used to deliver the source signal S71 in turn, and in the latter half of the enable period T71*b* of the gate signal G71, the second group (even-numbered source lines SL2, SL4, SL6) is used to deliver the source signal S71 in turn.

It should be mentioned that, the display driver apparatuses provided in the above-mentioned embodiments are also suitable for driving a low temperature polysilicon (LTPS) thin-film liquid crystal display panel.

Figure 9:
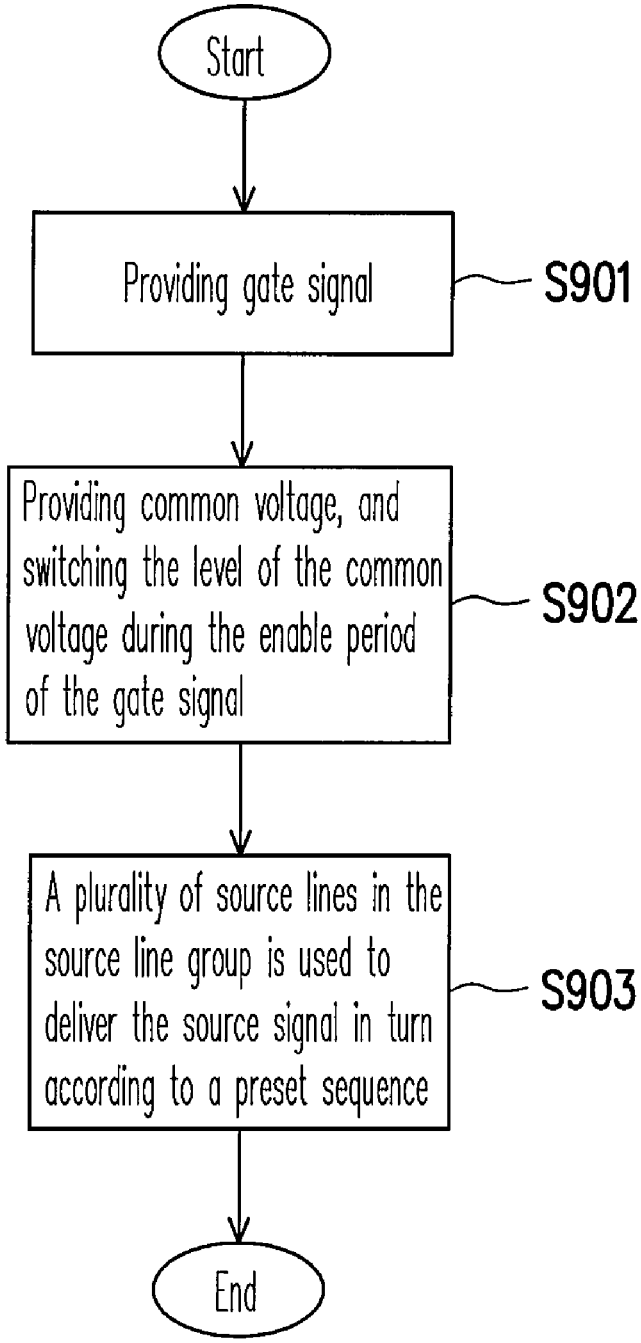
FIG. 9 is a flow chart of an inversion driving method according to an embodiment of the present invention.

In addition to the inversion driving apparatus used for the liquid crystal display panel, the present invention also provides an inversion driving method used for a liquid crystal display panel. FIG. 9 is a flow chart of an inversion driving method for a liquid crystal display panel according to an embodiment of the present invention. The flow chart of the method of this embodiment is just like the operation process of the driver apparatus in the aforementioned embodiment.

First, in step S901, a gate signal for turning on/off the sub-pixels is provided to the liquid crystal display panel. In step S902, a common voltage is provided to the liquid crystal display panel, and the level of the common voltage is switched during the enable period of the gate signal. After that, in step S903, during the enable period of the gate signal, a source signal is delivered to each source line group respectively, wherein a plurality of source lines in each source line group deliver the source signal in turn according to a preset sequence. The preset sequence for the source line group to deliver the source signal and other details of this method have been described in the above embodiments, which thus will not repeated herein any more.

In summary, the present invention utilizes the common voltage generation unit to switch the level of the common voltage during the enable period of the gate signal, and works together with the multiplexer unit to change the manner for a plurality of source lines in the source line group to deliver the source signal in turn. Therefore, the display driver apparatus achieves a plurality of inversion driving manners, thereby effectively enhancing the image quality of the display.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A display driver apparatus, suitable for driving a liquid crystal display panel, wherein the liquid crystal display panel comprises a plurality of source lines and a plurality of sub-pixels, the display driver apparatus comprising:

a gate drive unit, coupled to the liquid crystal display panel and used to generate a gate signal for turning on/off the sub-pixels, wherein the sub-pixels are turned on during a enable period of the gate signal;

a source drive unit, together with the gate signal, used for generating a source signal for the display panel;

a multiplexer unit, with an input terminal being coupled to the source drive unit to receive the source signal, with a plurality of output terminals being respectively coupled to the source lines one by one, wherein the multiplexer unit is used to couple the input terminal to one of the output terminals in turn during the enable period of the gate signal;

a common voltage generation unit, used for generating a common voltage to the liquid crystal display panel, wherein the common voltage generation unit switches the level of the common voltage within the enable period of the gate signal, wherein the level of the common voltage comprises a first voltage level and a second voltage level, when the level of the common voltage is the first voltage level, the corresponding source signal is of a first drive polarity, and when the level of the common voltage is the second voltage level, the corresponding source signal is of a second drive polarity; and a timing generator, coupled to the multiplexer unit and used for outputting M switch signals SWi according to a preset sequence, wherein the switch signal SWi is used to determine the connection state between an input terminal and an $i^{th}$ output terminal of the multiplexer unit, SWi represents the $i^{th}$ switch signal, M is an integer larger than 0, and is an integer and $1 \leqq i \leqq M$.

2. The display driver apparatus as claimed in claim 1, wherein the multiplexer unit comprises:

M switches, with the first ends being coupled to an output terminal of the source drive unit, with the second ends being respectively coupled to the source lines one by one, wherein the control terminal of the $i^{th}$ switch is used to receive the switch signal SWi.

3. The display driver apparatus as claimed in claim 1, wherein the preset sequence is that, the timing generator outputs the switch signals $SW_1, SW_3, \ldots, SW_{M-1}$ respectively in the first half of the enable period of the gate signal, and outputs the switch signals $SW_2, SW_4, \ldots, SW_M$ respectively in the latter half of the enable period of the gate signal.

4. The display driver apparatus as claimed in claim 1, wherein the preset sequence is that, the timing generator outputs the switch signals $SW_1, SW_2, \ldots, SW_{M/2}$ respectively in the first half of the enable period of the gate signal, and outputs the switch signals $SW_{(M/2)+1}, SW_{(M/2)+2}, \ldots, SW_M$ respectively in the latter half of the enable period of the gate signal.

5. The display driver apparatus as claimed in claim 1, wherein the first drive polarity is a positive polarity and the second drive polarity is a negative polarity.

6. The display driver apparatus as claimed in claim 1, wherein the first drive polarity is a negative polarity and the second drive polarity is a positive polarity.

7. The display driver apparatus as claimed in claim 1 is suitable for driving a low temperature poly-silicon thin-film liquid crystal display panel.

8. An inversion driving method, suitable for driving a liquid crystal display panel, wherein the liquid crystal display panel comprises a plurality of source line groups and a plurality of sub-pixels, and each of the source line groups comprises a plurality of source lines, the inversion driving method comprising the following steps:

providing a gate signal to the liquid crystal display panel, and turning on the sub-pixels during a enable period of the gate signal;

providing a common voltage to the liquid crystal display panel, and switching the level of the common voltage within the enable period of the gate signal; and delivering a source signal to each of the source line groups respectively during the enable period of the gate signal, wherein the source lines in each of the source line groups is used to deliver the source signal in turn according to a preset sequence, the level of the common voltage comprises a first voltage level and a second voltage level, when the level of the common voltage is the first voltage level, the corresponding source signal is of a first drive polarity, and when the level of the common voltage is the second voltage level, the corresponding source signal is of a second drive polarity, wherein the source lines in each of the source line groups are divided into a first group and a second group, and the step of delivering the source signal in turn according to the preset sequence comprises:

delivering the source signal to the first group in turn in the first half of the enable period of the gate signal; and delivering the source signal to the second group in turn in the latter half of the enable period of the gate signal, wherein the enable period of the gate signal is divided into the first half of the enable period and the latter half of the enable period according to the time point for switching the level of the common voltage.

9. The inversion driving method as claimed in claim 8, wherein the first group is the odd-numbered source lines in the source line group, and the second group is the even-numbered source lines in the source line group.

10. The inversion driving method as claimed in claim 8, wherein the first group is the first half of source lines in the source line group, and the second group is the latter half of source lines in the source line group.

11. The inversion driving method as claimed in claim 8, wherein the first drive polarity is a positive polarity and the second drive polarity is a negative polarity.

12. The inversion driving method as claimed in claim 8, wherein the first drive polarity is a negative polarity and the second drive polarity is a positive polarity.

13. The inversion driving method as claimed in claim 8 is suitable for driving a low temperature poly-silicon thin-film liquid crystal display panel.

* * * * *